US007083349B2

(12) United States Patent
Iida et al.

(10) Patent No.: US 7,083,349 B2
(45) Date of Patent: Aug. 1, 2006

(54) WRITING IMPLEMENT

(75) Inventors: Hisashi Iida, Yokohama (JP); Shigeru Okumura, Yokohama (JP); Kazuaki Matsumoto, Yokohama (JP); Seiichi Kobayashi, Yokohama (JP); Yusuke Kobayashi, Yokohama (JP)

(73) Assignee: Mitsubishi Pencil KabushikiKaisha, Tokyo (JP)

( * ) Notice: Subject to any disclaimer, the term of this patent is extended or adjusted under 35 U.S.C. 154(b) by 155 days.

(21) Appl. No.: 10/487,545

(22) PCT Filed: Aug. 23, 2002

(86) PCT No.: PCT/JP02/08521

§ 371 (c)(1),
(2), (4) Date: Feb. 24, 2004

(87) PCT Pub. No.: WO03/018328

PCT Pub. Date: Mar. 6, 2003

(65) Prior Publication Data

US 2004/0247369 A1 Dec. 9, 2004

(30) Foreign Application Priority Data

| | | |
|---|---|---|
| Aug. 24, 2001 | (JP) | 2001-254000 |
| Aug. 28, 2001 | (JP) | 2001-258437 |
| Sep. 5, 2001 | (JP) | 2001-268172 |
| Sep. 21, 2001 | (JP) | 2001-290002 |
| Sep. 26, 2001 | (JP) | 2001-293592 |
| Mar. 6, 2002 | (JP) | 2002-059875 |

(51) Int. Cl.
*B43K 5/02* (2006.01)
*B43K 7/00* (2006.01)
*A46B 11/06* (2006.01)

(52) U.S. Cl. ..... 401/42; 401/41; 401/209

(58) Field of Classification Search ..... 401/41, 401/42, 198, 199, 192, 209
See application file for complete search history.

(56) References Cited

U.S. PATENT DOCUMENTS

| | | | | |
|---|---|---|---|---|
| 1,935,639 | A * | 11/1933 | Keeshan | 401/192 |
| 1,978,676 | A | 10/1934 | Kingman | 120/42 |
| 1,998,930 | A | 4/1935 | Kingman | 120/42 |
| 3,993,409 | A | 11/1976 | Hart | 401/199 |
| 5,433,545 | A | 7/1995 | Keil | 401/40 |
| 6,244,774 | B1 | 6/2001 | Barosso et al. | 401/198 |
| 6,517,273 | B1 * | 2/2003 | Koyama et al. | 401/198 |

FOREIGN PATENT DOCUMENTS

| | | |
|---|---|---|
| JP | 14-14173 Y1 | 9/1939 |
| JP | 15-7603 Y1 | 6/1940 |
| WO | 01/70515 A1 | 9/2001 |

* cited by examiner

*Primary Examiner*—David J. Walczak
(74) *Attorney, Agent, or Firm*—Kubovcik & Kubovcik

(57) ABSTRACT

A writing implement includes a cylindrical shaft member, a pen tip member which is fixed to one end of the shaft member and from which colored ink seeps out, liquid for ink which is stored in the shaft member and which comprises a part of the colored ink seeping out from the end of the pen tip member, and colorant to be added to the above described liquid for ink to be the colored ink. Moreover, at least a part of a cylindrical side surface of the shaft member corresponding to the storing part of the liquid for ink is formed to be transparent. Between the liquid for ink and the colorant-storing part storing the colorant is provided a colorant-adsorbing core which introduces the liquid for ink into the colorant-storing part while capturing the colorant diffusing toward the storing part of the liquid for ink.

10 Claims, 14 Drawing Sheets

C ; colorant A ; adsorbing core

WRITING IMPLEMENT

TECHNICAL FIELD

The present invention belongs to a field related to manufacture of a writing implement which uses ink. The writing implement stores liquid for ink and colorant separately therein, both of which are to be included in the ink, whereby the colorant is added to the liquid for ink in process of introducing the liquid for ink to a tip member of the pen in order to produce colored ink, thereby allowing for writing in the colored ink.

BACKGROUND ART

Prior Art

A writing implement, which stores colored ink therein and introduces the ink to a tip of the writing implement in order to write down, specifically includes a fountain pen, a ballpoint pen, a felt pen, a sign pen (a marking pen), or a needle pen, for example. In the case of the ink which is used for such a writing implement, dye or pigment is dissolved or dispersed in vehicle matter (solvent or medium) substantially uniformly in advance, and the ink is so prepared that its color shown when contained in the writing implement is almost the same as that shown when transferred to a writing surface.

The present applicant has discovered Japanese Utility Model Publication No. 15-7603 as a technique related to the present invention.

The document discloses a solid-ink fountain pen, and its FIG. 1 shows a mechanism of allowing for advance and retreat of a water-stopper by turning a member such as a member. However, the figure is so incomplete that it is presumed that the advance and retreat is impossible. Even if the advance and retreat is possible, the advance and retreat of the arrow-headed water-stopper cannot prevent water infiltration resulting in ink leakage and has little practicality. Moreover, since the fountain pen described in the document stores solid ink which is to be mixed with water being separately stored, it is not a writing implement having a specific appearance.

OBJECT OF THE PRESENT INVENTION

An object of the present invention is to provide a writing implement having a specific appearance. That is, an object of the present invention is to provide a writing implement having a specificity of inconsistency between an appearance thereof and a feeling of use thereof that the color and thickness of liquid stored in a shaft member thereof is different from that of a written line.

DISCLOSURE OF THE INVENTION

Basic Constitution

To achieve an object of the present invention, following constitutions are required.

First, such a structure is necessary that transparent liquid for ink and colorant for coloring the liquid for ink are separately stored in the writing implement, and that the transparent liquid for ink is visible.

Second, such a structure is necessary that the transparent liquid for ink and the colorant for coloring the liquid for ink can be mixed to be supplied to a pen tip when writing.

Third, such a structure is necessary that the colored ink having been colored by the colorant may not mix into a storing part of the transparent liquid for ink when not writing.

Constitution 1

Constitution 1 relates to a writing implement in which liquid for ink and colorant are separately stored, comprising a cylindrical shaft member, a pen tip member which is fixed to one end of the shaft member and from which colored ink seeps out, the liquid for ink which is stored in the shaft member and which comprises a major component of the colored ink seeping out from an end of the pen tip member, and the colorant to be added to the liquid for ink to be the colored ink.

Moreover, at least a part of a cylindrical side surface of the shaft member corresponding to a part where the liquid for ink is stored is formed to be transparent, and between the storing part of the liquid for ink and colorant-storing part storing the colorant, colorant-adsorbing core is provided which introduces the liquid for ink into the colorant-storing part while capturing the colorant diffusing toward the storing part of the liquid for ink.

Terminology for Constitution 1

The "shaft member" may be a member integrated into the storing container of the liquid for ink to make up the shaft, or may also be a cylindrical hollow member in which a freely detachable ink cartridge is used as the storing container of the liquid for ink, the ink cartridge being stored in the shaft member and interchangeably formed.

The words that "at least a part of a cylindrical side surface of the shaft member corresponding to a part where the liquid for ink is stored is formed to be transparent" means that, though it is general that the part where the liquid for ink is stored is entirely formed to be transparent, a writing implement whose part where the liquid for ink is stored is partially formed to be transparent may be included in the present invention.

The words that "liquid for ink and colorant are separately stored" means that, inside the writing implement, the liquid for ink and the colorant, both of which are to be included in the ink, are respectively stored in physically different spaces. That is, as described in the terminology related to the shaft member, a freely detachable ink cartridge may be used as a storing container of the liquid for ink, for example.

The "liquid for ink" may be vehicle matter included in the conventional ink (which is colorless and transparent liquid that mainly consists of the conventional ink other than its dye or pigment), or may also be colored liquid which is obtained by adding dye or pigment to the vehicle matter. According to the constitution of the present invention, the colorant is added in process of introducing the liquid for ink to the pen tip member. Therefore, in the former case, the colorless and transparent liquid for ink is transferred on a writing surface as a line drawn with colored ink. In the latter case, the color and thickness of the drawn line can be different from those of the liquid for ink.

Concretely, the vehicle matter in the conventional ink can be used for the "liquid for ink" as it is. Thus, the transparent or translucent liquid for ink can be prepared. Moreover, for example, by adding a predetermined component to the vehicle matter of the conventional ink, or by removing a predetermined component from the vehicle matter of the conventional ink, the transparent or translucent liquid for ink can be prepared. Moreover, for example, by dissolving or dispersing a very small amount of dye or pigment in the vehicle matter of the conventional ink, colored and transparent or translucent liquid for ink can also be prepared. In the manner, for example, the liquid for ink whose color has the same hue as the colorant and is very pale can be prepared. Moreover for example, the liquid for ink whose color has a different hue from the colorant and is very pale can also be prepared. The way in which the liquid for ink is prepared depends on the appearance desired.

The vehicle matter as the liquid for ink can be prepared by blending, for example, water, water-soluble organic solvent, lubricant, preservative, anti-corrosive, pH-controlling agent, anti-drying agent, thickener, and emulsion as appropriate.

The "colorant" is for producing colored ink by being added to the above-described liquid for ink.

For example, dye or pigment included in the conventional ink can be used. Thereby, colorant in solid form or in highly-concentrated liquid form can be prepared. Moreover, for example, by dissolving or dispersing an extremely large amount of dye or pigment in the vehicle matter of the conventional ink, the colorant in highly-concentrated liquid form can be prepared. Moreover, for example, by dissolving or dispersing an extremely large amount of dye or pigment in a predetermined component in the vehicle matter of the conventional ink, the colorant in highly-concentrated liquid form can also be prepared. The way in which the colorant is prepared depends on the way in which the colorant is added to the liquid for ink.

Moreover, as the dye for the colorant, for example, direct dye, acid dye, basic dye, fluorescent dye, or food color can be used. Moreover, as the pigment for the colorant, for example, inorganic pigment, organic pigment, inorganic fluorescent pigment, or organic fluorescent pigment can be used. Moreover, a "main component of the colorant" means all of the colorant as well as a substantial portion of the colorant.

Furthermore, detailed explanation will be made below in the embodiments with respect to water, water-soluble organic solvent, lubricant, preservative, anti-corrosive, pH-controlling agent, anti-drying agent, thickener, emulsion, direct dye, acid dye, basic dye, fluorescent dye, food color, inorganic pigment, organic pigment, inorganic fluorescent pigment, and organic fluorescent pigment.

With respect to the shape of the colorant, in case of solid form, a merely small bulky shape, a ring shape, or a lotus shape can be selected as appropriate.

A "pen tip member" means, for example, a nib when the writing implement is a fountain pen, a ball pen tip when the writing implement is a ballpoint pen, a writing tip made of felt when the writing implement is a felt pen, a writing tip made of fiber bundle when the writing implement is a sign pen (a marking pen), or an elongated tubular writing tip when the writing implement is a needle pen. Furthermore, since the writing implement is not limited to those described above, the pen tip member is not limited to those described above as well.

The colorant is added to the liquid for ink in process of introducing the liquid for ink to the pen tip member. Examples of such aspects are as follows. First, in process of introducing the liquid for ink to the pen tip member, the colorant in solid form is added to the liquid for ink with the colorant gradually dispersed therein when the liquid for ink is passing through the storing part of the colorant in solid form. Second, in process of introducing the liquid for ink to the pen tip member, the colorant in liquid form is added to the liquid for ink with the colorant gradually mixed therewith when the liquid for ink is passing through the storing part of the colorant in liquid form. Third, in process of introducing the liquid for ink to the pen tip member, the colorant in liquid form is directly added to the liquid for ink.

The colorant-adsorbing core is a member for capturing and adsorbing the colorant from the colored ink which has been added with the colorant but has not been consumed by writing operation. As is defined in the other constitutions, the member is most typically made of a powder type or fiber type of activated carbon which is made into a porous body, and formed to, for example, a column-shaped body. In addition to the activated carbon, the member can be made of zeolite, silica gel, alumina, or high polymers.

It is also possible to use substance having a capillary activity such as substance processed by bundling fibers, resin mold whose inner part is made to have a capillary activity, or resin mold whose outer part is made to have a capillary activity.

Function of Constitution 1

Since at least a part of a cylindrical side surface of the shaft member corresponding to a part where the liquid for ink is stored is formed to be transparent, the user of the writing implement according to the present invention can visually recognize the liquid for ink. On the other hand, the colored ink whose color or thickness is different from the liquid for ink seeps out of the pen tip member when writing, so that the user can have a unique feeling that the appearance of the implement is not consistent with the feeling of use. For example, the user can draw a blue line despite the visual recognition of the colorless liquid for ink, or the user can draw a black line despite the visual recognition of pale red liquid for ink.

When writing, the liquid for ink is fed to the colorant to be mixed therewith. Then the colorant is added to the liquid for ink and the colored ink seeps out of the end of the pen tip member to be written. When not writing, the colorant contained in the colored ink, which has been added with the colorant and has not been consumed by writing, is captured by the colorant-adsorbing core. Consequently, the liquid for ink can stably maintain the color and its thickness for a middle-and-long term.

Constitution 2

Constitution 2 relates to a writing implement referred to as a so-called double-headed pen, in which liquid for ink and colorant are separately stored therein.

That is, the writing implement, which stores therein the liquid for ink and two colorant separately, comprises a cylindrical shaft member, two pen tip members which are fixed to both ends of the shaft member and from which colored ink seeps out, the liquid for ink which is stored in the shaft member and which comprises a major component of the colored ink seeping out from ends of the pen tip members, two colorant to be added to the liquid for ink to be the colored ink, and colorant-adsorbing cores each of which is provided between the storing part of the liquid for ink and each of colorant-storing parts for storing each of the two colorant and each of which introduces the liquid for ink into each of the colorant-storing part while capturing each of the two colorant diffusing toward the storing part of the liquid for ink.

Terminology for Constitution 2

When two pen tip members are fixed at both ends of the shaft member, respectively, two storing parts of the liquid for ink may be provided independently for each of the two pen tip members or one storing part may be shared by the two pen tip members. The latter is more preferable because the liquid for ink can be effectively consumed to the end. In the former case, on the other hand, it is likely that one of the two pen tips becomes unable to write sooner than another.

Function of Constitution 2

Since at least a part of a cylindrical side surface of the shaft member corresponding to a part where the liquid for ink is stored is formed to be transparent, the user of the writing implement according to the present invention can visually recognize the liquid for ink. On the other hand, the colored ink whose color or thickness is different from the liquid for ink seeps out of the pen tip member when writing, so that the user can have a unique feeling that the appearance of the implement is not consistent with the feeling of use.

When writing by using either of the pen tip members, the liquid for ink is fed to the colorant to be mixed therewith. Then the colorant is added to the liquid for ink and the colored ink seeps out of the end of the pen tip member to be written. When not writing, the colorant contained in the colored ink, which has been added with the colorant and has not been consumed by writing, is captured by the colorant-adsorbing core. Consequently, the liquid for ink can stably maintain the color and its thickness for a middle-and-long term.

Constitution 3

Constitution 3 is a limited constitution of Constitution 1 or 2.

That is, the constitution relates to the writing implement in which the colorant-adsorbing core is made of a porous body mainly composed of activated carbon.

The porous body mainly composed of activated carbon can easily be manufactured and a shape of the porous body can be freely designed, and further, the porous body holds superiority in capturing the colorant.

Constitution 4

Constitution 4 is a limited constitution of any one of Constitutions 1 to 3.

That is, the constitution relates to the writing implement in which a part of an axial length of colorant-adsorbing core is positioned in the storing part of liquid for ink.

Colorant contained in colored ink, which has been added thereto and has not been consumed by writing, is captured by the colorant-adsorbing core. If the colorant-adsorbing core cannot completely adsorb the colorant and the colored ink seeps into the storing part of the liquid for ink, the part of the colorant-adsorbing core positioned in the storing part of the liquid for ink captures the colorant from the colored ink. Consequently, the liquid for ink can stably maintain the color and its thickness for a middle-and-long term.

Constitution 5

Constitution 5 is a limited constitution of any one of Constitutions 1 to 4.

That is, the constitution relates to the writing implement wherein the colorant-adsorbing core is made of a porous column-shaped body mainly composed of activated carbon, the colorant is formed as colorant-adding core impregnated with colorant material, and a flow rate restriction part in which an area contacting between an end of the colorant-adsorbing core on the side of the pen tip member and an end of the colorant-adding core opposite to the pen tip member becomes smaller than those of other portions is provided.

The "flow rate restriction part" means a part whose cross section perpendicular to a flowing direction becomes smaller than those of other portions. For example, the flow rate restriction part includes a throttle part and a contraction part each of which is formed as a portion of the colorant-adding core as well as a flow rate restriction member which is provided as an individual member separated from a flow rate regulating core.

Providing the flow rate restriction part, it is possible to restrict an amount of the colored ink, which is added with the colorant at the colorant-adding core, flowing into the colorant-adsorbing core. Consequently, the liquid for ink can stably maintain the color and its thickness for a middle-and-long term.

Constitution 6

Constitution 6 is a limited constitution of any one of Constitutions 1 to 5.

That is, the constitution relates to the writing implement wherein the colorant is formed as colorant-adding core impregnated with colorant material, and an ink-introducing core for introducing colored ink colored at the colorant-adding core into a pen tip member is provided.

The ink-introducing core is a bundle of fibers whose porosity is 30% or more, for example. However, it is preferable to use a bundle of fibers whose porosity is 40% or more.

Since the ink-introducing core is provided separately from the colorant-adding core, the flexibility in designing the whole of the writing implement is improved. Moreover, since the colored ink can be reserved to a certain degree even when the colorant-adding core cannot be refilled with the liquid for ink, the writing implement is suitable for long-term writing.

Constitution 7

Constitution 7 is a limited constitution of any one of Constitutions 1 to 6.

That is, the constitution relates to the writing implement wherein a flow rate regulating core for regulating a flow rate of the liquid for ink is provided between an end of the colorant-adsorbing core on the side of the pen tip member and an end of the colorant-adding core opposite to the pen tip member.

Providing the flow rate regulating core, it is possible to restrict an amount of the colored ink, which has been added with the colorant at the colorant-adding core, flowing into the colorant adsorbing core. Consequently, the liquid for ink can stably maintain the color and its thickness for a middle-and-long term.

Constitution 8

Constitution 8 is a limited constitution of Constitution 7.

That is, the constitution relates to the writing implement wherein the flow rate regulating core is made of a porous column body or a fiber bundle-shaped column body having an appropriate porosity.

Since the flow rate regulating core is made of a porous column body or a fiber bundle-shaped column body having an appropriate porosity, it is possible to restrict an amount of the colored ink, which has been added with the colorant, flowing into the colorant-adsorbing core. Consequently, the liquid for ink can stably maintain the color and its thickness for a middle-and-long term.

Constitution 9

Constitution 9 is a limited constitution of any one of Constitutions 1 to 8.

That is, the constitution relates to the writing implement wherein insoluble substance whose specific gravity is approximately the same as that of the liquid for ink is dispersed in the storing part of the liquid for ink.

"Insoluble substance" herein is solid matter which does not dissolve in the liquid for specific gravity is approximately the same as that of the liquid for ink such as minute thin sheets made of thermoplastic resins. The substance can also be made of thin metal film, a small metal object, metal powder, or a small glass object, for example. Moreover, a trade name, a company name, or characters can be applied to a surface of the substance, or alternatively, the substance itself can take the form of such characters.

Moreover, as to the "insoluble substance," the words that its "specific gravity is approximately the same as that of the liquid for ink" means that the insoluble substance suspends in the liquid for ink, that is, a difference of their specific gravities is 15% or less, preferably 10% or less, and more preferably 5% or less.

If the difference is larger than 15%, the insoluble substance floats up and down so fast that it gives little interest. On the other hand, if the difference is smaller than 5%, the insoluble substance floats up and down so slowly that it may show innovative interest.

At least a part of the cylindrical side surface of the shaft member corresponding to the storing part of the liquid for ink is transparent. Moreover, since the insoluble substance contained in the storing part of the liquid for ink has approximately the same specific gravity as that of the liquid for ink, these substance may flutter in the liquid for ink when writing and is also suspended in the liquid when not writing. Therefore, the writing implement can display its new promotion ability which advertises an application of innovative design.

Constitution 10

Constitution 10 is a limited constitution of any one of Constitutions 1 to 9.

That is, the constitution relates to the writing implement wherein the storing part of the liquid for ink is provided with a pressure-regulating part for preventing an increase or decrease of a pressure in the storing part.

The "pressure-regulating part" herein is means for constantly maintaining a pressure in the storing part according to the air expansion or contraction caused by consumption of the liquid for ink or by the temperature change. It is, for example, general to provide the pressure-regulating part as a communicating hole at a rear end of the shaft member for communicating an inner space of the shaft member with the air outside. When using such an embodiment of the pressure-regulating part, it may often be necessary to prevent the leakage of the liquid from the communicating hole. In such a case, at an end of the liquid for ink opposite to the pen tip member is often provided greasy, pasty or gellous non-drying substance, or a slide plug.

Another embodiment of the pressure-regulating part is, for example, a valve mechanism. Namely, the valve is opened in response to the pressure change in order to communicate the inner space of the shaft member with the air outside, resulting in that the liquid for ink or the air outside can be introduced or discharged.

Moreover, another embodiment of the pressure-regulating part is means using a capillary activity by which the liquid flows into a space with little influence at a positive pressure and by which air flows in at a negative pressure (e.g. a collector).

The embodiment of the pressure-regulating part is not only limited to the above-described ones, but also a combination of some of the above-described ones.

Although the pressure in the storing part of the liquid for ink may increase and decrease due to an outside temperature or heat transmission in use, leakage of the liquid for ink caused by the increase and decrease thereof can be prevented by using the pressure-regulating part which controls the increase and decrease of the pressure.

BEST MODE FOR CARRYING OUT THE INVENTION

As described below, with respect to the writing implement according to the present invention, its principal variations are described first and then each embodiment is explained in detail.

FIG. 1

FIG. 1 schematically shows variations of components.

There are three constitutive requirements as described above. According to the first requirement, liquid for ink and colorant which colors the liquid for ink are separately stored in a writing implement and the liquid for ink can be visually recognized. The first requirement should be the means to be achieved in all of "a" to "j." That is, at least a part of a cylindrical side surface of a shaft member corresponding to a part where the liquid for ink is stored is formed to be transparent.

According to the second requirement, it is necessary to provide means for mixing the liquid for ink with the colorant which colors the liquid for ink to supply to a pen tip when writing. In "c," "f" and "g" are illustrated different means to be achieved from the others.

Third, it is necessary to provide a structure in which colored ink having been colored with the colorant may not mix to the storing part of the liquid for ink when not writing. Each of "a" to "j" commonly adopts a colorant-adsorbing core (abbreviated to "adsorbing core" in the figure).

In "a," between the storing part of the liquid for ink and the colorant is located the colorant-adsorbing core.

In "b," between the colorant and the colorant-adsorbing core is located a restriction part.

In "c," the colorant is impregnated in a colorant-adding core (abbreviated to "adding core" in the figure), and thus the colored ink added with the colorant at the colorant-adding core reaches a pen tip through an introducing core.

In "d," between the colorant and the colorant-adsorbing core is located a regulating core.

In "e, "a part of the colorant-adsorbing core is located in the storing part of the liquid for ink, thereby adsorbing the colorant immersed into the storing part.

In "f," between the colorant-adding core and the colorant-adsorbing core is located an intermediate core.

In "g," as in the case of "c," the introducing core, the colorant-adding core, and the colorant-adsorbing core are provided, and the restriction part is provided between the colorant-adding core and the colorant-adsorbing core.

In "h," which illustrates a so-called double-headed pen, between the storing part of the liquid for ink and both of the two colorant are located two colorant-adsorbing cores.

In "i," liquid-insoluble substance is suspended in the liquid for ink, thereby further achieving a unique appearance.

FIRST EMBODIMENT

Figure 1A:
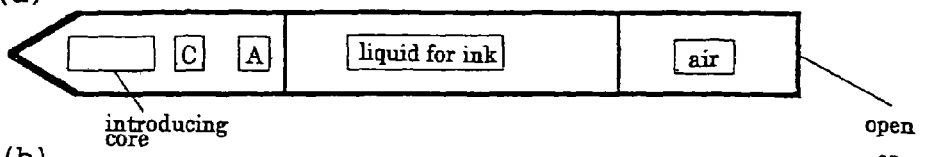
FIGS. 1(*a*) to 1(*i*) are conceptual diagrams showing variations of components.
Figure 1B:
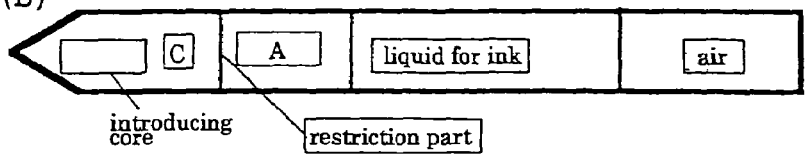
Figure 1C:
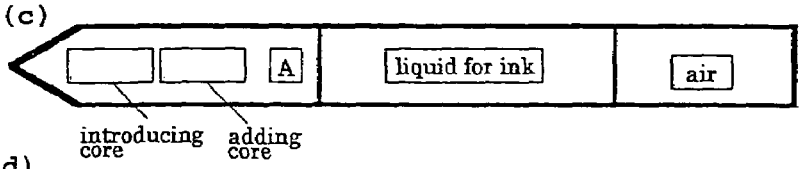
Figure 1D:
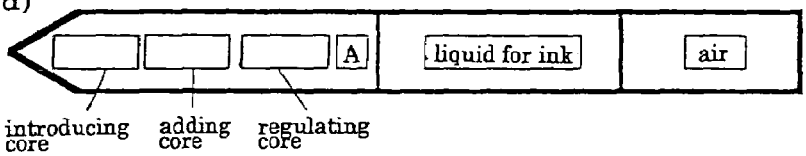
Figure 1E:
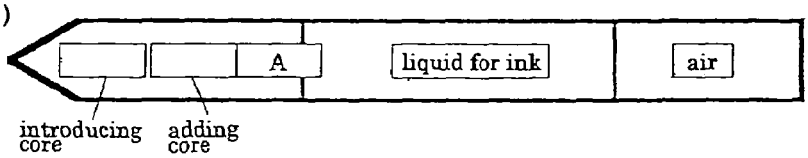
Figure 1F:
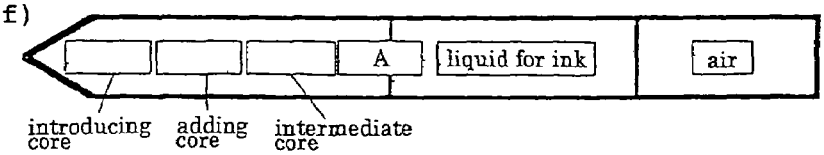
Figure 1G:
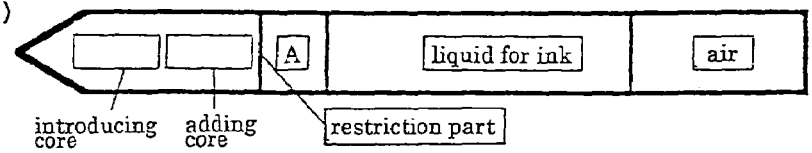
Figure 1H:
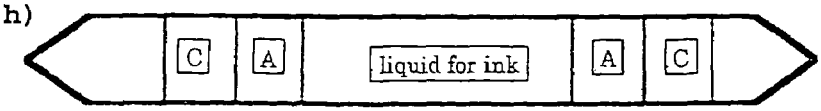
Figure 1I:
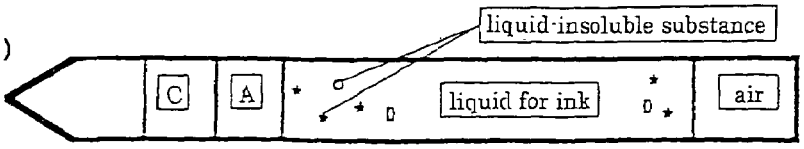
Figure 2:
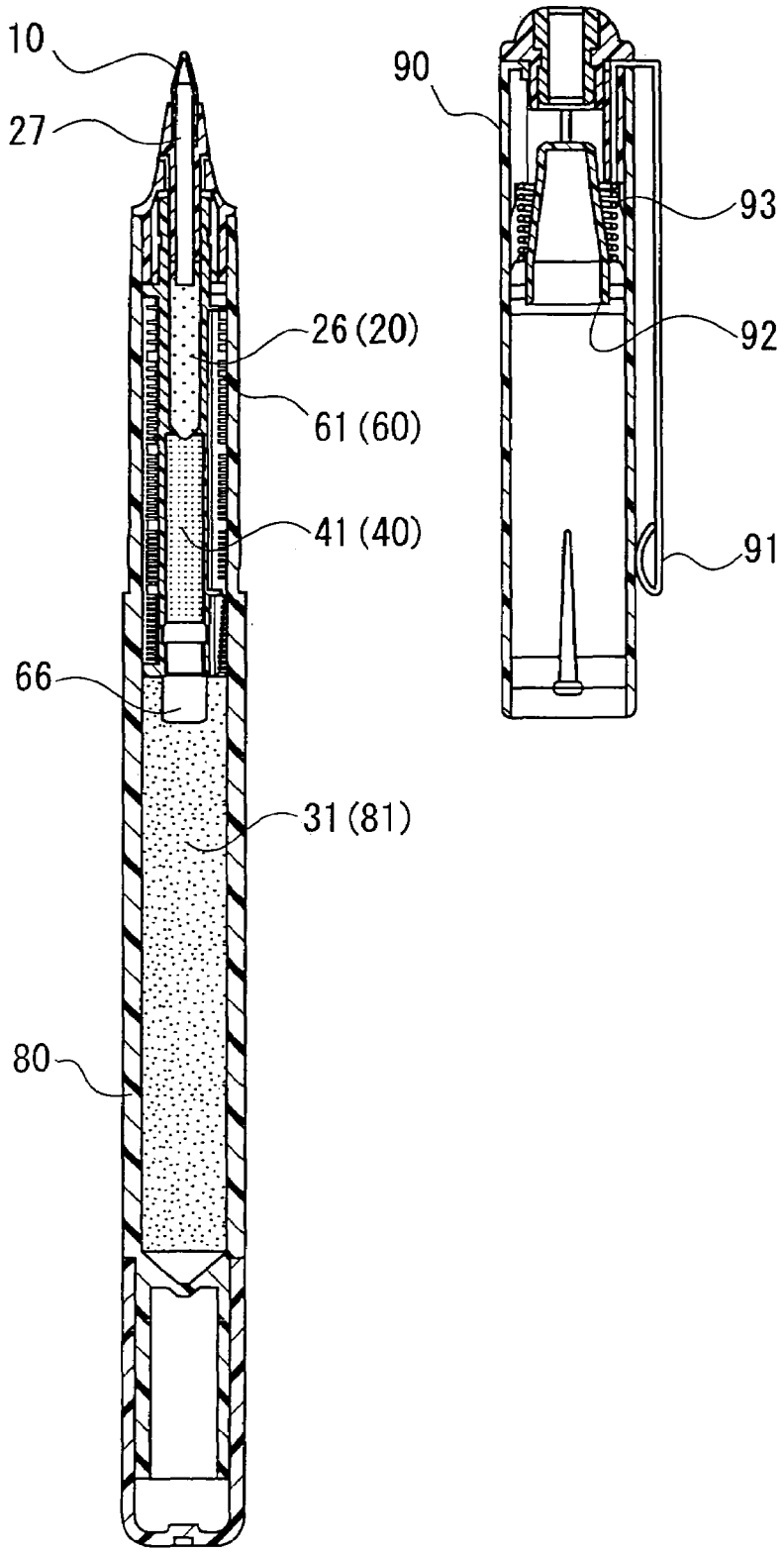
FIG. 2 is a cross sectional view showing a whole of the first embodiment.
Figure 3:
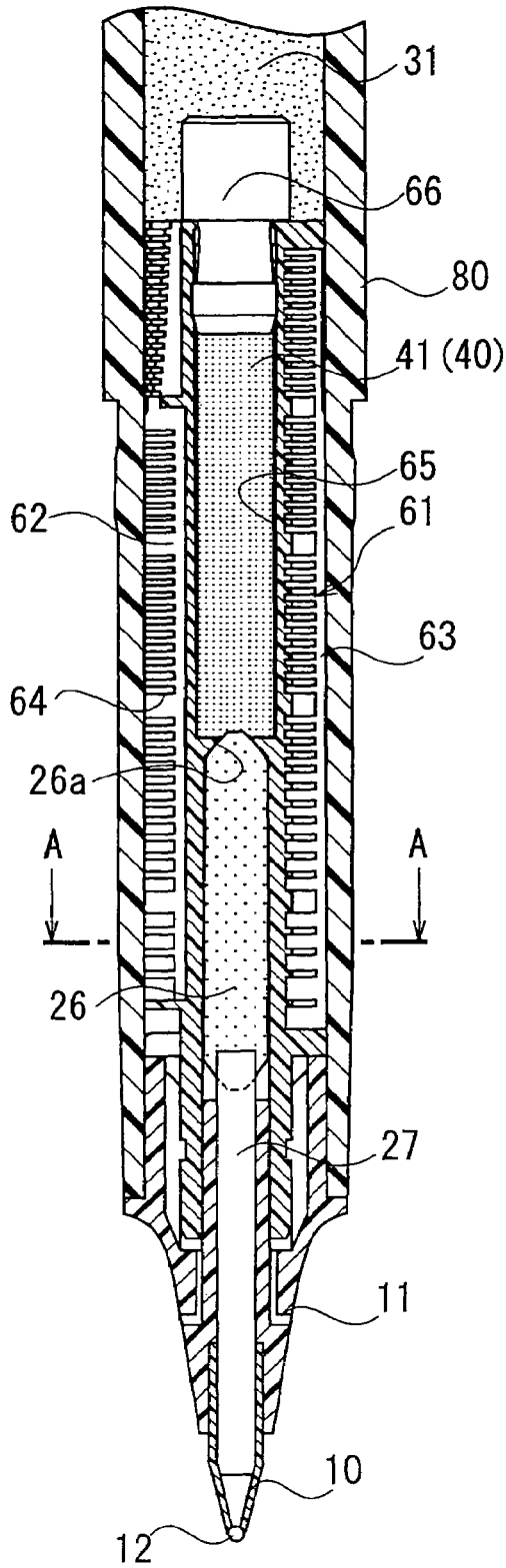
FIG. 3 is a cross sectional view showing a principal part of the first embodiment.
Figure 4:
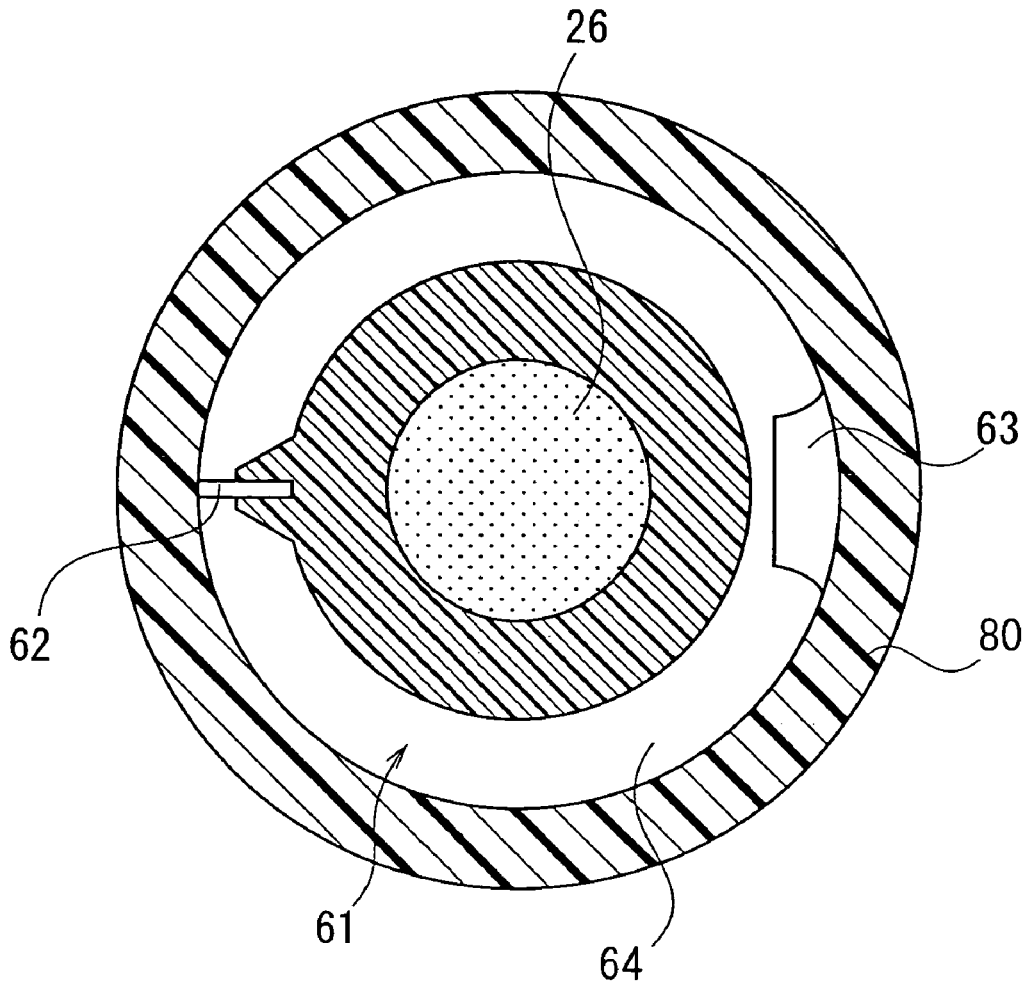
FIG. 4 shows a section along a line A—A in FIG. 3.

Next, the first embodiment will be described with reference to FIGS. 2 to 4. The embodiment corresponds to the type "g" illustrated in FIG. 1.

The writing implement comprises a cylindrical shaft member 80 and a pen tip member 10 provided in front of the member 80 (above the member 80, in FIG. 2), and also comprises a liquid-storing part 81 for storing liquid for ink 31 in an interior of a rear side of the shaft member 80. The liquid-storing part 81 is wholly made of synthetic resin such as polypropylene (PP) in order to show a colorless and transparent appearance so that an internal structure can be visually recognized. The shaft member 80 may not always be formed in a cylindrical shape, but its periphery may be formed in a polygonal shape.

Moreover, the shaft member 80 may not always be formed to be colorless and transparent, but may be formed to be colored and transparent, or translucent, for example. Further, the whole shaft member 80 may not always be formed to be transparent, but, for example, a transparent window may be provided at a part of the shaft member 80 so that its interior may be visually recognized.

Furthermore, as well as the whole shaft member 80 is formed to be transparent, on a periphery of its gripping position may be provided an elastic grip which is transparent or opaque, or on its surface may be applied some characters, graphic symbols, or patterns.

Collector 61 as Pressure-Regulating Part

In the liquid-storing part 81, the liquid for ink 31 flows into a pen tip member 10, but its rear end is closed. Moreover, with respect to the liquid-storing part 81, a pressure-regulating part 60 for preventing an increase or decrease of a pressure in the liquid-storing part 81 is provided at a side of the pen tip member 10. The pressure-regulating part 60 is generally referred to as a "collector 61," and regulates a pressure while flowing the liquid into a space with little influence at a positive pressure as well as allowing the admission of air at a negative pressure. Further details are explained below.

Around the periphery of the collector 61 are provided a liquid-introducing groove 62 formed from a rear end on the side of the liquid-storing part 81 to the side of the pen tip member 10, an air-displacing groove 63 formed from a front end on the side of the pen tip member 10 to the side of the liquid-storing part 81, and many liquid-reserving grooves 64 formed to intersect with both of the liquid-introducing groove 62 and the air-displacing groove 63. The air-displacing groove 63 communicates with air channels 11 which are provided at the pen tip member 10, and secure the communication with outside of the writing implement.

Thereby the pressure change in the liquid-storing part 81 is regulated. That is, in case of a positive pressure where the pressure increases due to warmed air in the liquid-storing part 81, the liquid for ink 31 is allowed to flow into the liquid-reserving grooves 64. In case of a negative pressure where the pressure decreases due to the consumption of the liquid for ink 31 after writing, air is taken from outside of the writing implement through the air-displacing groove 63 and the air channels 11.

The collector 61 is made of synthetic resin such as ABS and formed to be entirely colorless and transparent. However, the collector 61 may not always be formed to be colorless and transparent. For example, it may be formed to be either colored and transparent, translucent, or opaque. That is, the collector 61 may be so formed that the inside thereof may or may not be visually recognized.

Through a center of the collector 61 is provided a penetrating channel 65 penetrating from a rear end thereof to a front end on the side of the pen tip. The penetrating channel 65 may not be always formed cylindrically, but, for example, an inner periphery of the penetrating channel 65 may be made polygonal. Moreover, for example, around an inner peripheral surface of the penetrating channel 65 may be provided with many grooves continuously running from the rear end on the side of the liquid-storing part 81 to the front end on the side of the pen tip member 10.

Colorant-Adsorbing core 41

A cylindrical colorant-adsorbing core 41 is inserted into an end of the penetrating channel 65 on the side of the liquid-storing part 81. A colorant-adding core 26 for introducing the liquid for ink 31, which has been introduced from the liquid-storing part 81 through the colorant-adsorbing core 41, to the side of the pen tip member 10 is inserted into an end of the penetrating channel 65 on the side of the pen tip member 10 so that the front end of the colorant-adsorbing core 41 may be embedded into, or come into contact with, the rear end of the colorant-adding core 26.

The colorant-adsorbing core 41 is formed to be a porous and cylindrical column made of a powder type or a fiber type of activated carbon. It introduces the liquid for ink 31 from the colorant-adsorbing core 41 to the colorant-adding core 26 as well as prevents the colorant 20 from moving toward the side of the storing part of the liquid for ink 31 by adsorbing the colorant diffused from the colorant-adding core 26.

Collector Core 66

A collector core 66 is fixed to a rear end of the penetrating channel 65 of the collector 61, with the colorant-adsorbing core 41 fixed thereto. The collector core 66 fixes the colorant-adsorbing core 41, introduces the liquid for ink 31 to the colorant-adsorbing core 41, and further functions as a safety device for preventing the colorant 20 not having been adsorbed by the colorant-adsorbing core 41 from mixing into the liquid-storing part 81 and the liquid-reserving grooves 64 of the collector 61.

Colorant 20

The colorant-adding core 26 is impregnated with the colorant 20. Thus, the colorant 20 and the liquid for ink 31 are achieved to be stored separately. Moreover, the colorant 20 is made to be added to the liquid for ink 31 in process of introducing the liquid for ink to the pen tip member 10.

The colorant-adding core 26 is formed in a cylindrical columnar shape by a bundle of fibers. The bundle of fibers whose porosity is suitable for introducing the liquid for ink 31 is employed. Though, in the case of the conventional writing implement, a bundle of fibers whose porosity is 30% or more has been used as an ink-introducing core, it is preferable to use a bundle of fibers whose porosity is 40% or more. The is because the bundle of fibers is intended to be impregnated with the colorant 20.

The colorant-adding core 26 may not always be made of a bundle of fibers, but may be made of, for example, a porous body. Moreover, the colorant-adding core 26 may also be made of synthetic resin such as polyacetal, polypropylene, or polyester. In the case, around an outer peripheral surface of the core is provided many capillary grooves, slits, or concaved portions continuously running from an end to another, or, alternatively, inside the core is provided many capillary grooves, capillary channels, or concaved portions penetrating from an end to another.

The colorant-adding core 26 comes into contact with an ink-introducing core 27 for introducing the colored ink into the pen tip member 10. However, the contacting portion with the ink-introducing core 27 is tapered to reduce its diameter relative to other portions, thereby narrowing the contacting portion. Moreover, as shown in FIG. 3, the contacting portion with the colorant-adsorbing core 41 is also tapered to reduce its diameter relative to other portions, thereby narrowing the contacting portion. The portion having such a reduced diameter (a contraction part) is referred to as a flow rate restriction part 26*a*. Providing the flow rate restriction part 26*a*, it is possible to restrict an amount of the colored ink, which has been added with the colorant 20 at the colorant-adding core 26, flowing into the colorant-adsorbing core 41. Consequently, the liquid for ink 31 can stably maintain the color and its thickness for a middle-and-long term.

Pen Tip Member

As for a pen tip member 10 positioned at a front portion of the writing implement, various types can be adopted as appropriate depending on the type of the writing implement. The embodiment employs a ball pen tip. The ball pen tip freely and rotatably holds a tip ball 12 at the front end thereof, from which the colored ink seeps out in response to the rotation of the ball 12 to write. The colored ink is prepared by the liquid for ink 31 passing through the colorant-adding core 26 and the ink-introducing core 27. The liquid for ink 31 is introduced to the colorant-adding core 26 and the ink-introducing core 27 after passing through the collector core 66 and the colorant-adsorbing core 41. The front end of the ink-introducing core 27 is inserted into an interior of the ball pen tip 10, and thus, the ink having passed through the colorant-adding core 26 and the ink-introducing core 27 is introduced to the tip ball 12.

The pen tip member 10 may also be formed of a writing tip made of felt, a writing tip made of a bundle of fibers, or an elongated tubular writing tip used for a needle pen.

If the writing implement is left for a long time without using it for writing, the colorant diffuses into the liquid for ink, so that there is a danger that its appearance becomes similar to that of the conventional one.

Thus, the colorant-adsorbing core 41 is formed to be a porous and cylindrical column made of powder or fibrous matter mainly consisted of activated carbon for the purpose of capturing and adsorbing the colorant during its diffusion, which introduces the liquid for ink 31 from the colorant-adsorbing core 41 to the colorant-adding core 26, adsorbs the colorant diffused from the colorant-adding core 26, and prevents the colorant 20 from moving toward the liquid-storing part 81.

Liquid for Ink and Colorant

In the present embodiment, vehicle matter of the conventional ink is used for the liquid for ink 31.

The colorant 20 of the present embodiment corresponds to dye or pigment of the conventional ink, and is mainly composed of the conventional ink other than the vehicle matter. A user of the writing implement according to the present embodiment can visually recognize the liquid for ink 31 which has not been colored yet. When writing, on the other hand, the colored ink seeps out from the pen tip member 10, so that the user can have a unique feeling that the appearance of the implement is not consistent with the feeling of use.

Cap

The writing implement comprises a cap 90 in the shape of a cylinder an end of which is closed, in order to protect the pen tip member 10 and to prevent drying. The cap 90 comprises a clip 91 for clipping to a breast pocket or the like, and a pen tip enclosing part 92 conformed to a contour of the pen tip member 10 in its interior. The pen tip enclosing part 92 can move forward and back in an axial direction by an enclosing spring 93, so that the pen tip member 10 can be hermetically enclosed to a high degree and is prevented from drying caused by the air channel 11 provided at the pen tip member 10 and by the tip ball 12.

Others

The way of storing the colorant 20 in the writing implement is not always limited to the case where the colorant-adding core 26 is impregnated with the colorant 20. For example, though not shown in the figures, a pore provided at a center of the collector 61 may be filled with the colorant prepared in solid or liquid form, or the colorant prepared in liquid form may be applied to an inner peripheral surface of the pore to be solidified. Furthermore, the colorant prepared in liquid form may be applied to the outer peripheral surface of the ink-introducing core 27 to be assimilated, or the colorant prepared in solid form may be embedded in the ink-introducing core 27. Further, the colorant in liquid form may be stored in the other potion than the ink storing part 81 such that the colorant can be gradually added to the liquid for ink 31 according to the flow of the liquid for ink 31.

Although in the present embodiment and the others is shown a writing implement comprising the collector 61, the present invention is not always limited to the writing implement having such a collector, but can be used for, e.g., a sign pen, a marking pen, or a ballpoint pen of a direct-ink-supply type without such a collector.

The shaft member 80A may not always be made of polypropylene (PP) as its material. It may be made of such material as: e.g., vinyls such as polyvinyl chloride (PVC), polyvinyl butyral (PVB), polyvinyl alcohol (PVA), polyvinylidene chloride (PVDC), polyvinyl acetate (PVAC), polyvinyl formal (PVF), or polyvinyl dichloride; polystyrenes such as polystyrene (PS), styrene-acrylonitrile copolymer (AS), or ABS; polyethylenes such as ethylene-vinyl acetate copolymer (EVA); acrylics such as polymethyl methacrylate (PMMA) or modified acrylic; fluorine plastics such as polychlorotrifluoroethylene (PCTFE), polytetrafluoroethylene (PTFE), polytetrafluoroethylene-polyhexafluoropropylene copolymer (FEP), or polyvinylidene fluoride (PVDF); or others such as polyacetal (PA), polycarbonate (PC), phenoxy, polyester (PETP), polyurethane (PU), phenol-formaldehyde resin (PF), urea-formaldehyde resin (UF), melamine-formaldehyde resin (MF), epoxy resin (EP), furan resin (FF), xylene resin (XF), silicone resin, or nylon.

SECOND EMBODIMENT

Figure 5:
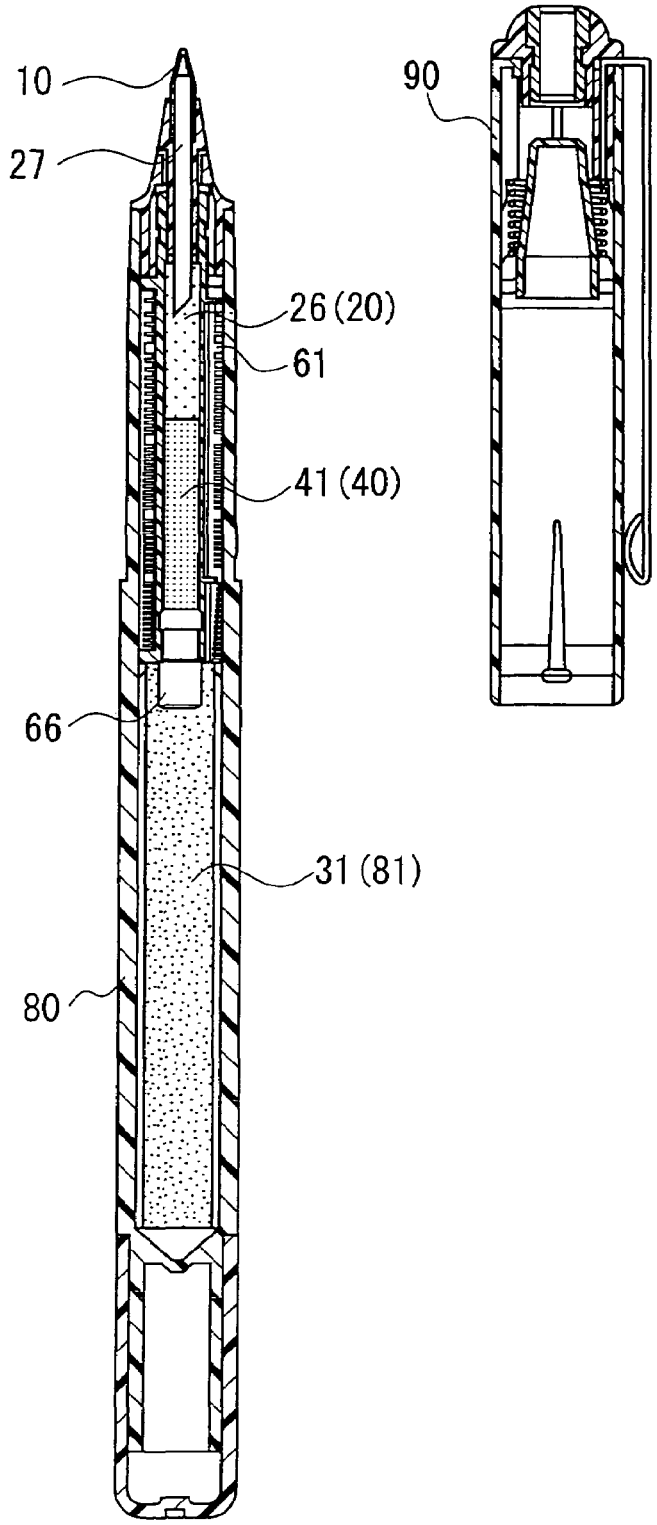
FIG. 5 is a cross sectional view showing a whole of the second embodiment.
Figure 6:
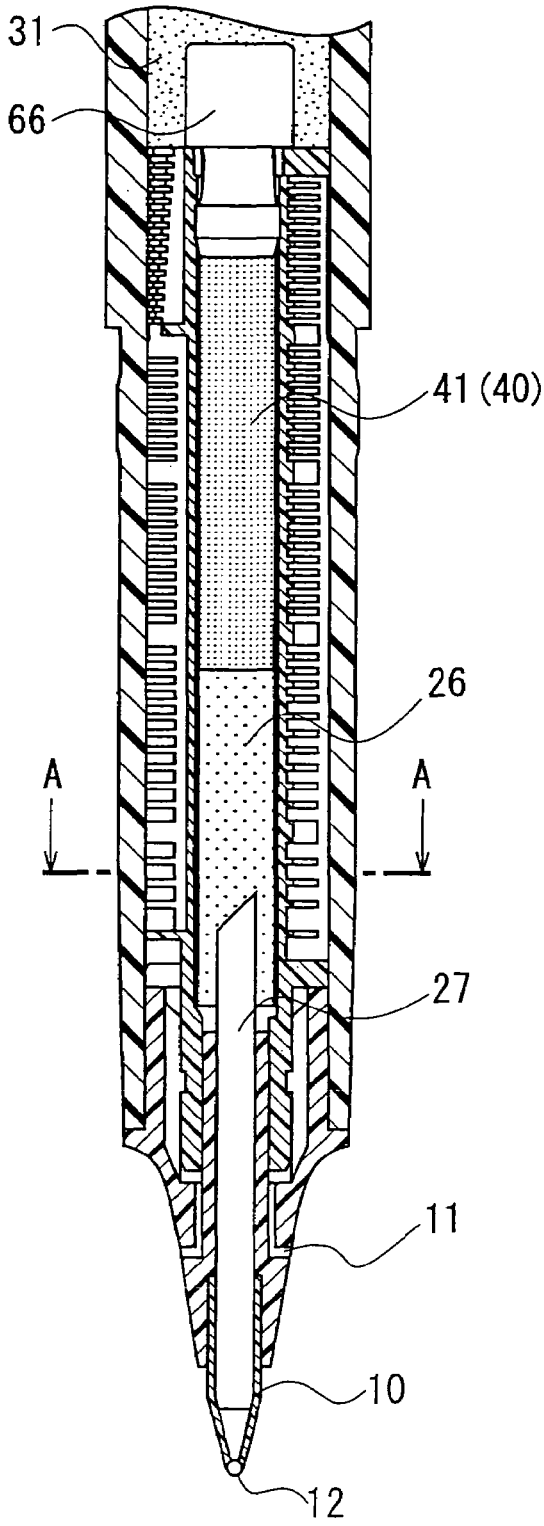
FIG. 6 is a cross sectional view showing a principal part of the second embodiment.

FIGS. 5 and 6 illustrate the second embodiment. The present embodiment corresponds to a type "c" in FIG. 1.

A difference between the present embodiment and the first one is a shape of colorant-adding core 26. That is, whereas, in the first one, the contacting portions with the ink-introducing core 27 and with the colorant-adsorbing core 41 are tapered to reduce their diameters relative to other portions in order to narrow the contacting portions, every portion has the same diameter in the present one. Although the object of the first one is to appropriately supply the liquid for ink 31 and to restrict a back flow of the colorant 20, the object of the second one is to smoothly supply the liquid for ink 31.

THIRD EMBODIMENT

Figure 7:
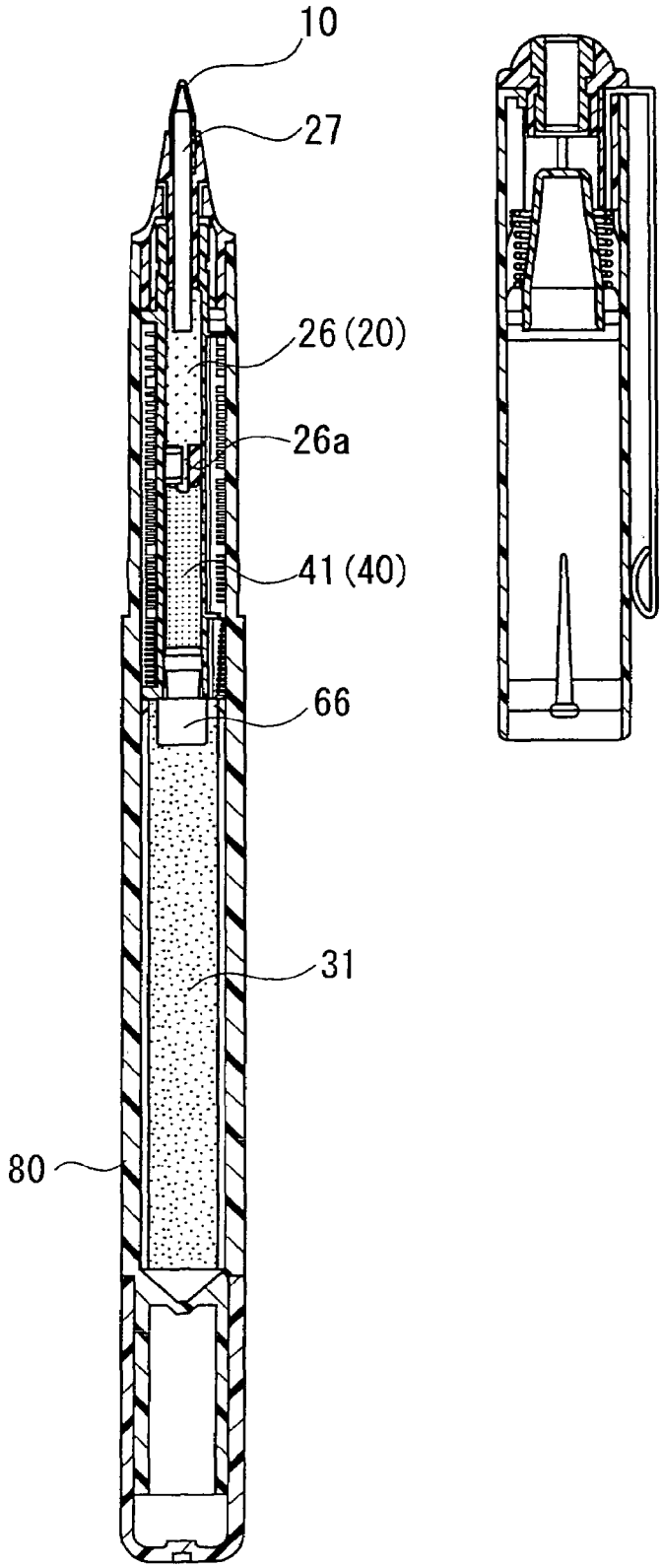
FIG. 7 is a cross sectional view showing a whole of the third embodiment.
Figure 8:
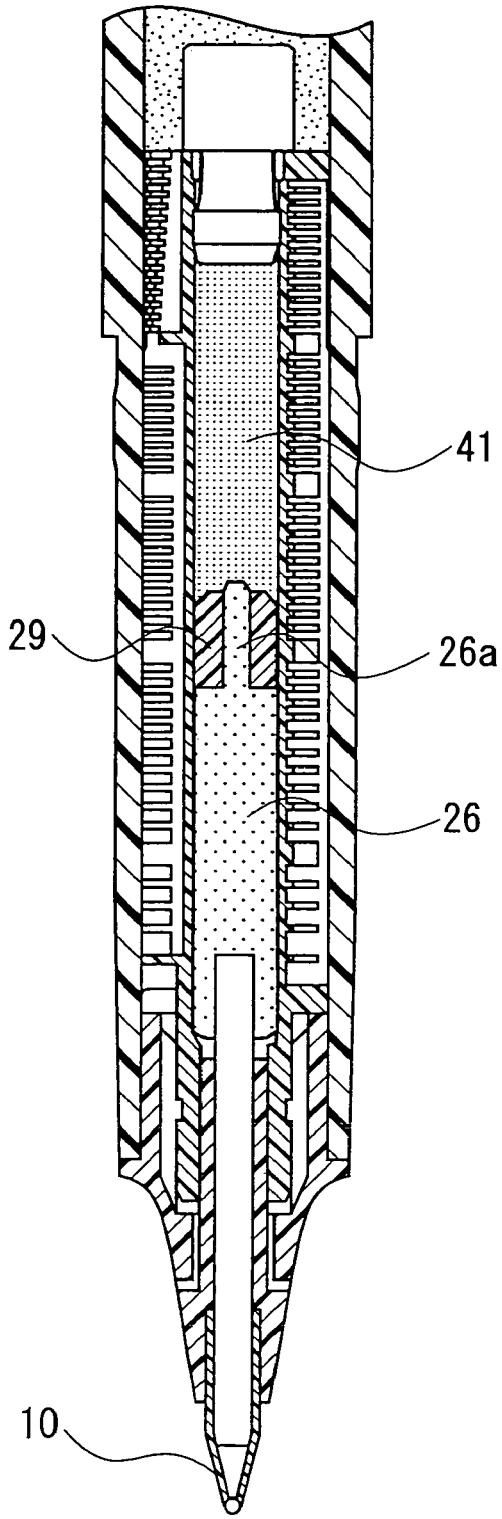
FIG. 8 is a cross sectional view showing a principal part of the third embodiment.

FIGS. 7 and 8 illustrate the third embodiment. The present embodiment corresponds to a type "g" in FIG. 1.

A difference between the present embodiment and the first one is also a shape of colorant-adding core 26. That is, the contacting portions with the ink-introducing core 27 and with the colorant-adsorbing core 41 function as the flow rate restriction part 26*a* (a throttle part) which is formed by reducing its diameter. Further, a flow rate restriction member 29 made of a cylindrical elastic body is plugged over the flow rate restriction part 26*a*. Consequently, as well as the first one, the liquid for ink 31 can be appropriately supplied and a back flow of the colorant 20 can also be restricted. Thus, the color and its thickness can be stably maintained for a long time.

As for the elastic flow rate restriction member 29, material through which the liquid for ink 31 cannot permeate such as synthetic resin, for example, is used.

FOURTH EMBODIMENT

Figure 9:
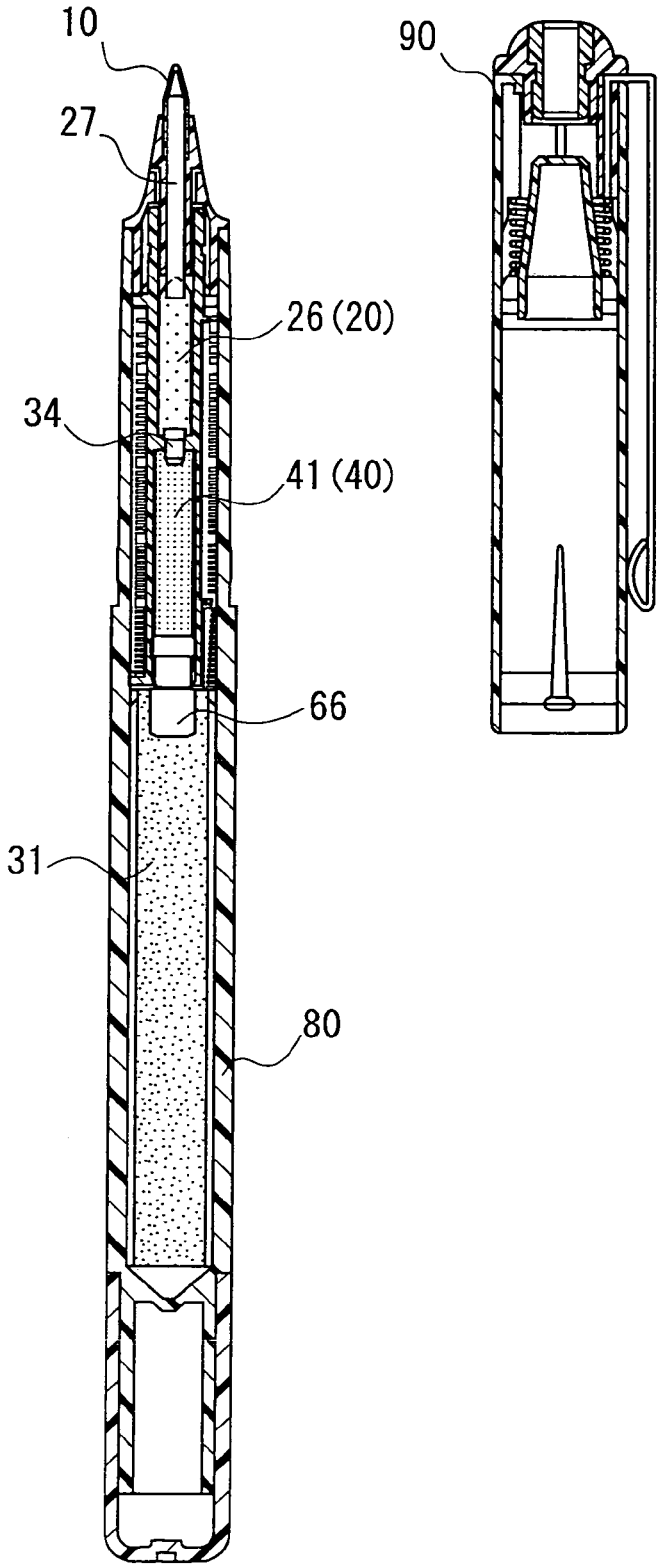
FIG. 9 is a cross sectional view showing a whole of the fourth embodiment.
Figure 10:
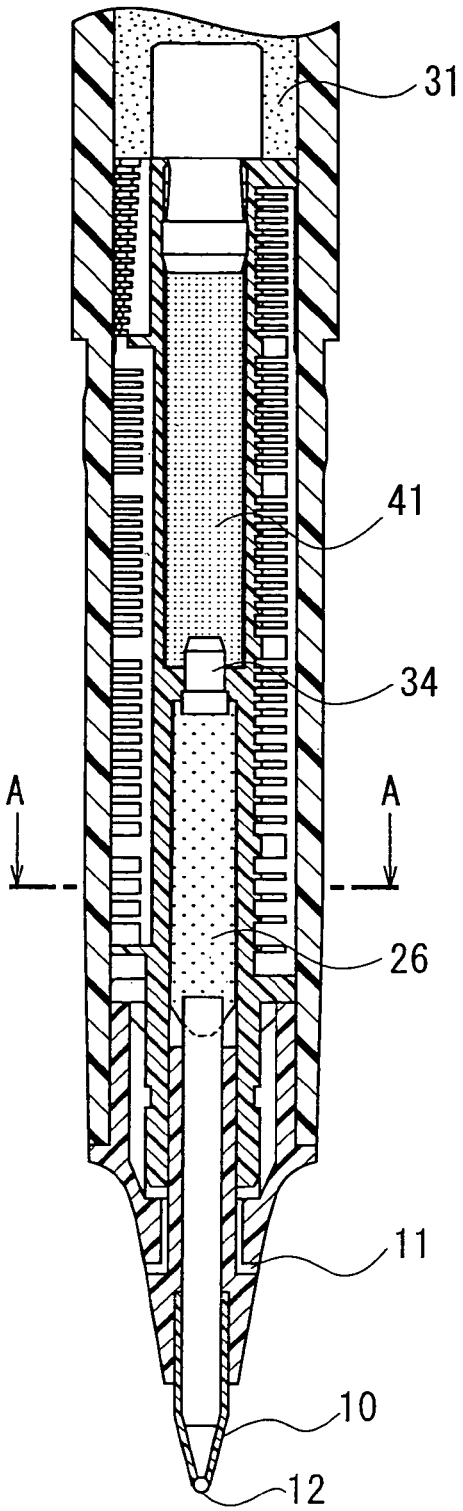
FIG. 10 is a cross sectional view showing a principal part of the fourth embodiment.

FIGS. 9 and 10 illustrate the fourth embodiment. The present embodiment corresponds to a type "d" in FIG. 1. A cross sectional view taken along a line A—A in FIG. 10 is completely the same as that shown in FIG. 4.

The present embodiment is different from the third one in that a flow rate regulating core 34 is interposed as a separate member instead of the direct contact between the ink-introducing core 27 and the colorant-adsorbing core 41.

Providing the flow rate regulating core 34, an amount of liquid for ink 31 is regulated while introducing the liquid for ink 31 from the colorant-adsorbing core 41 to the colorant-adding core 26, and colorant 20 diffused from the colorant-adding core 26 is firstly shut off by the flow rate regulating core 34, and then the diffused colorant 20 is further adsorbed by the colorant-adsorbing core 41. Thus, the colorant 20 is prevented from moving toward the liquid cartridge 30. Consequently, the color and its thickness can be stably maintained for a middle-and-long term.

The flow rate regulating core 34 is formed in consideration of its size, shape, porosity, material or the like as appropriate.

FIFTH EMBODIMENT

Figure 11:
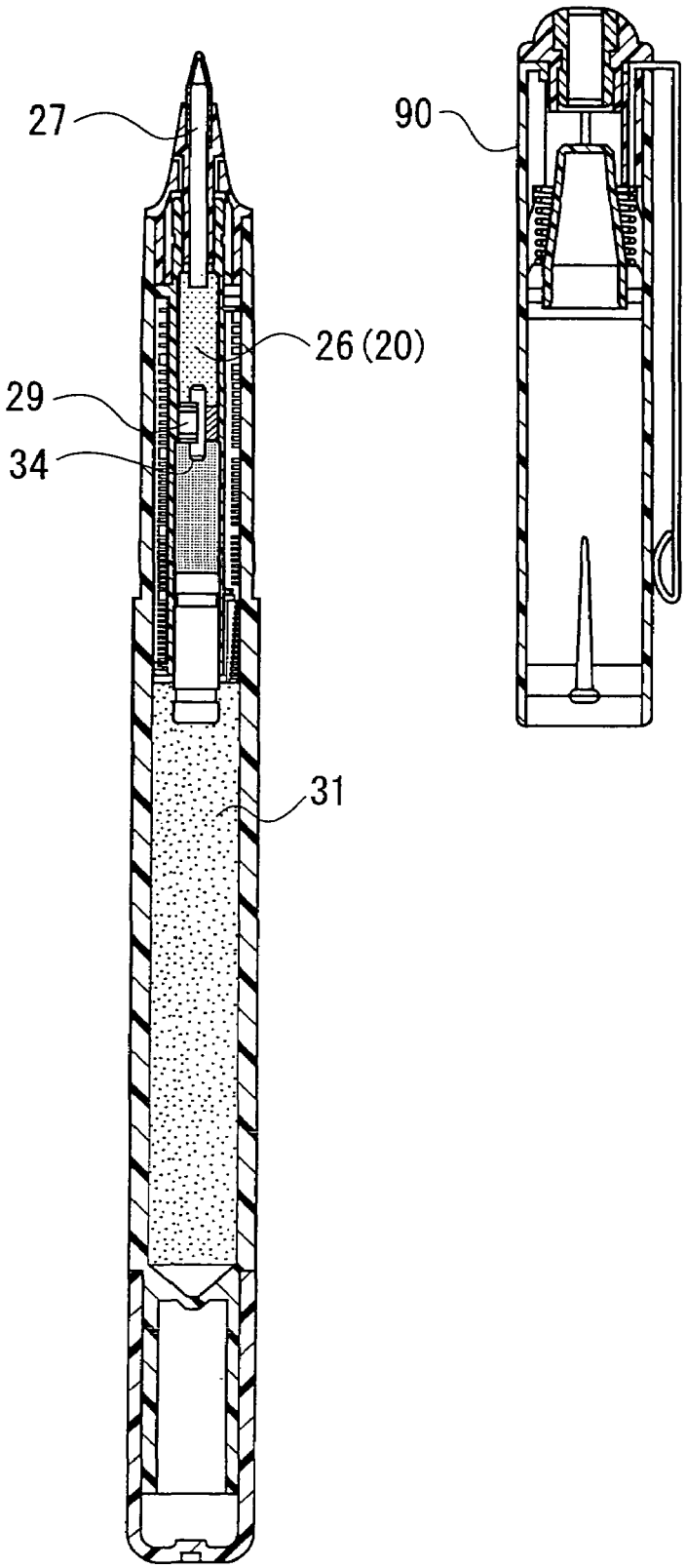
FIG. 11 is a cross sectional view showing a whole of the fifth embodiment.
Figure 12:
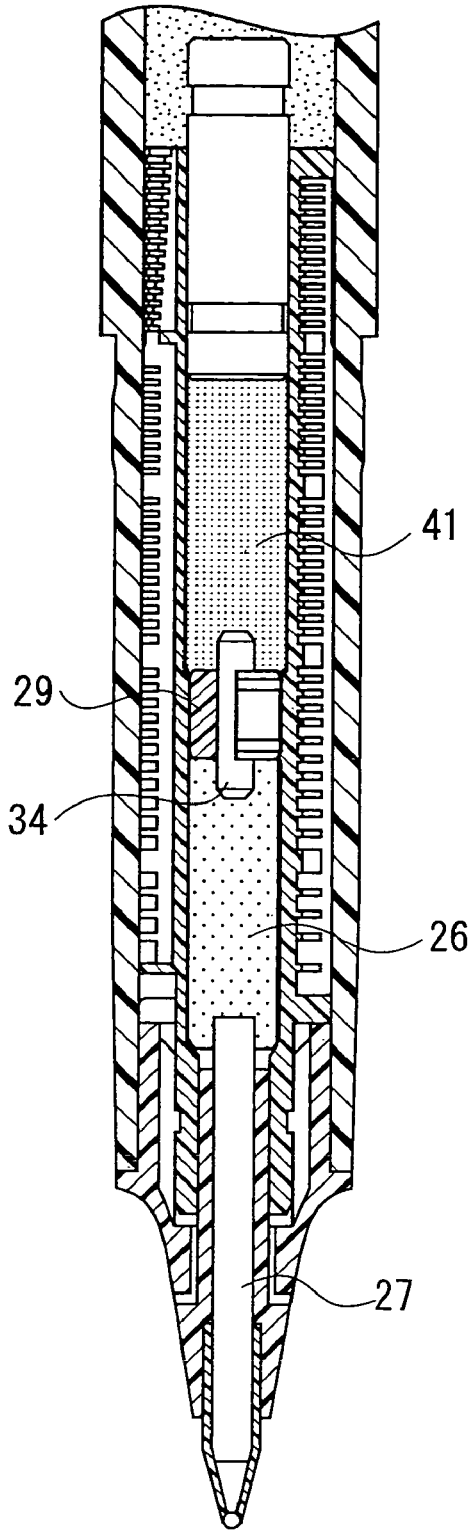
FIG. 12 is a cross sectional view showing a principal part of the fifth embodiment.

FIGS. 11 and 12 illustrate the fifth embodiment. The embodiment corresponds to a type "g" in FIG. 1.

The present embodiment is different from the fourth one in that, in addition to providing the flow rate regulating core 34, the flow rate restriction member 29 made of an elastic cylindrical body is plugged over the flow rate regulating core 34. Also as for the flow rate restriction member 29 which forms the flow rate controlling part, material through which the liquid for ink 31 cannot permeate such as synthetic resin, for example, is used.

Providing the flow rate regulating core 34 and the flow rate restriction member 29, as in the first embodiment, the liquid for ink 31 is appropriately supplied and a back flow of the colorant 20 is restricted. Consequently, the color and its thickness can be stably maintained for a middle-and-long term.

SIXTH EMBODIMENT

Figure 13:
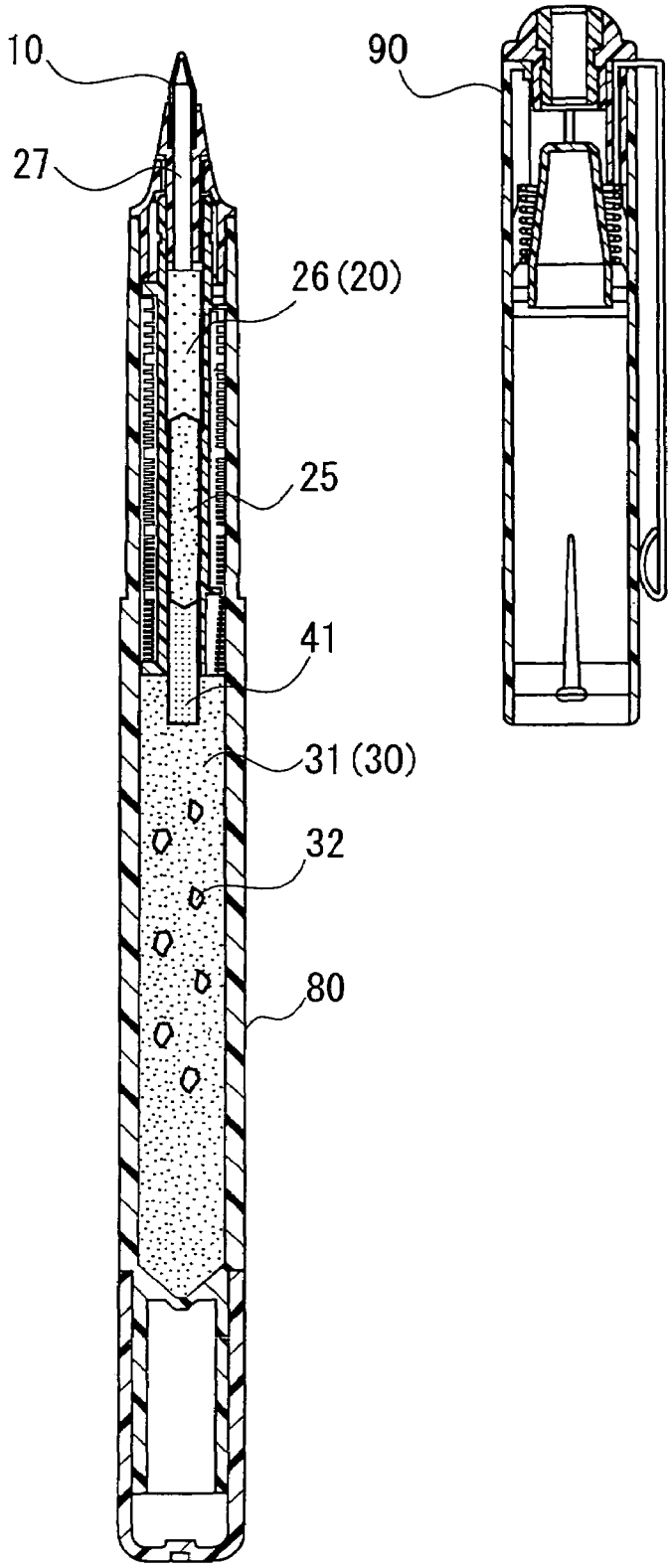
FIG. 13 is a cross sectional view showing a whole of the sixth embodiment.
Figure 14:
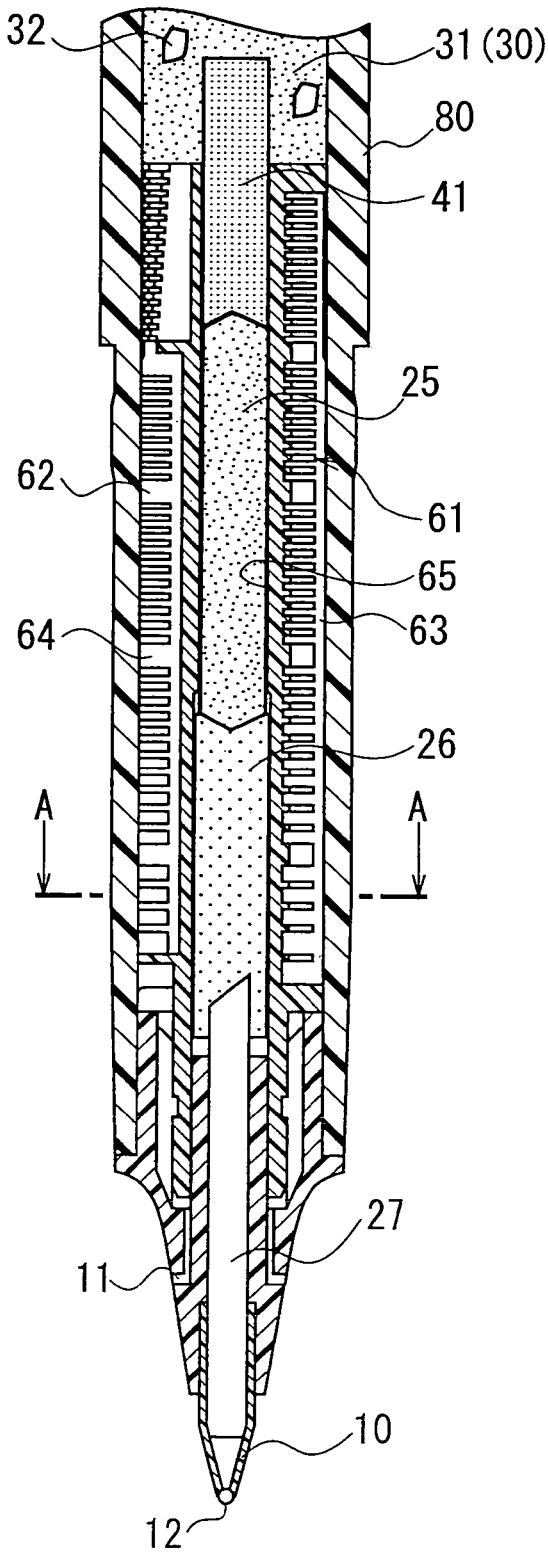
FIG. 14 is a cross sectional view showing a principal part of sixth embodiment.

FIGS. 13 and 14 illustrate the sixth embodiment. Across sectional view taken along a line A—A in FIG. 14 is completely the same as that shown in FIG. 4. The embodiment corresponds to a type "f" in FIG. 1.

The present embodiment is different from the others above-described in that the colorant-adsorbing core 41 is extended toward the storing part of the liquid for ink 31 and inserted into the liquid for ink 31, instead of providing the collector core 66. Moreover, the present embodiment is also different from the others in that an intermediate core 25 is provided between the colorant-adding core 26 and the colorant-adsorbing core 41. Further, the liquid for ink 31 is stored in the liquid cartridge 30 and the liquid cartridge 30 is stored in the shaft member 80.

The intermediate core 25 is inserted near the end of the collector 61 opposite to the pen tip member 10 in its center. The colorant-adsorbing core 41 is inserted to the end of the intermediate core 25 opposite to the pen tip member 10, such that the colorant-adsorbing core 41 comes into contact with, or is embedded in, the intermediate core 25. Further, the colorant-adsorbing core 41 is so fixed that its end opposite to the pen tip member 10 is located in the liquid for ink 31.

The intermediate core 25 is made of a porous or fibrous bundle-shaped core or the like, and regulates an amount of the liquid for ink 31 flowing from the colorant-adsorbing core 41 to the colorant-adding core 26. It further restricts the colorant 20 diffused from the colorant-adding core 26, and thus assists the colorant-adsorbing core 27 to prevent the colorant 20 from mixing into the storing part of the liquid for ink 31 by adsorbing the colorant 20.

By extending the colorant-adsorbing core 41 toward the storing part of the liquid for ink 31 to be inserted into the liquid for ink 31, the colorant 20 mixed into the storing part can be adsorbed. Consequently, the color and its thickness can be stably maintained for a long time.

The way of storing the colorant 20 in the shaft member 80 may not always be limited to the impregnation in the colorant-adding core 26 with the colorant. For example, a pore provided in the center of the collector 61 may be filled with the colorant prepared in solid or liquid form. Moreover, for example, the colorant prepared in liquid form may be applied to the inner peripheral surface of the pore to be solidified. Moreover, for example, the colorant 20 prepared in liquid form may be applied to the outer peripheral surface of the ink-introducing core 27 to be assimilated. Moreover, for example, the colorant 20 prepared in solid form may be embedded in the ink-introducing core 27. Further, the colorant in liquid form may be stored in the other portion than the storing part of the liquid for ink 31 so that the colorant can be gradually added to the liquid for ink 31 according to the flow of the liquid for ink 31.

The present invention can also be applied to a writing implement in which a shaft member 80 having a colorant storing part at a rear side of a pen tip member 10 and a liquid cartridge 30 containing liquid for ink 31 are separately provided, the liquid cartridge 30 is detachably mounted in the shaft member 80, and the liquid for ink 31 is introduced to colorant 20 when the liquid cartridge 30 is mounted. In such a case, the colorant 20 or the colorant-adsorbing core 26 is placed in front of the liquid for ink 31 in the liquid cartridge 30.

INDUSTRIAL APPLICABILITY

The present invention relates to the field of manufacturing writing implements using ink. The writing implement stores liquid for ink and colorant separately, both of which are to be included in the ink, whereby the liquid for ink, while being introduced to a pen tip member, is added with the colorant to be colored ink to write.

The invention claimed is:

1. A writing implement in which liquid for ink and colorant are separately stored, comprising:

a cylindrical shaft member;

a pen tip member which is fixed to one end of the shaft member and from which colored ink seeps out;

the liquid for ink which is stored in a storing part in the shaft member and which comprises a major component of the colored ink seeping out from an end of the pen tip member; and the colorant to be added to the liquid for ink to be the colored ink and provided in a colorant-storing part;

wherein at least a part of a cylindrical side surface of the shaft member corresponding to a part where the liquid for ink is stored is formed to be transparent; and wherein, between the storing part of the liquid for ink and colorant-storing part storing the colorant, a colorant-adsorbing core made of a porous body mainly composed of activated carbon is provided which introduces the liquid for ink into the colorant-storing part while capturing the colorant diffusing toward the storing part of the liquid for ink.

2. The writing implement according to claim 1, in which a part of an axial length of the colorant-adsorbing core is positioned in the storing part of liquid for ink.

3. The writing implement according to claim 1, wherein:

the colorant-adsorbing core is made of a porous column-shaped body mainly composed of activated carbon;

the colorant is formed as a colorant-adding core impregnated with colorant material; and a flow rate restriction part in which an area contacting between an end of the colorant-adsorbing core on the side of the pen tip member and an end of the colorant-adding core opposite to the pen tip member becomes smaller than those of other portions of the flow rate restriction part is provided.

4. The writing implement according to claim 3, wherein a flow rate regulating core for regulating a flow rate of the liquid for ink is provided between an end of the colorant-adsorbing core on the side of the pen tip member and an end of the colorant-adding core opposite to the pen tip member.

5. The writing implement according to claim 4, wherein the flow rate regulating core is made of a porous column body or a fiber bundle-shaped column body having an appropriate porosity.

6. The writing implement according to claim 1, wherein:

the colorant is formed as a colorant-adding core impregnated with colorant material; and an ink-introducing core for introducing colored ink colored at the colorant-adding core into the pen tip member is provided.

7. The writing implement according to claim 6, wherein a flow rate regulating core for regulating a flow rate of the liquid for ink is provided between an end of the colorant-adsorbing core on the side of the pen tip member and an end of the colorant-adding core opposite to the pen tip member.

8. The writing implement according to claim 7, wherein the flow rate regulating core is made of a porous column body or a fiber bundle-shaped column body having an appropriate porosity.

9. The writing implement according to claim 1, wherein an insoluble substance whose specific gravity is approximately the same as that of the liquid for ink is dispersed in the storing part of the liquid for ink.

10. The writing implement according to claim 1, wherein the storing part of the liquid for ink is provided with a pressure-regulating part for preventing an increase or decrease of a pressure in the storing part.

* * * * *